US005315952A

United States Patent [19]

Jackson, Jr.

[11] Patent Number: 5,315,952

[45] Date of Patent: May 31, 1994

[54] METHOD OF MAKING AND APPARATUS OF A VIEW WINDOW

[76] Inventor: Curtiss E. Jackson, Jr., 5514 Ridgeway Ct., Westlake Village, Calif. 91362

[21] Appl. No.: 966,502

[22] Filed: Oct. 19, 1992

Related U.S. Application Data

[63] Continuation-in-part of Ser. No. 697,221, May 7, 1991, abandoned.

[51] Int. Cl.[5] ..... B63B 19/00

[52] U.S. Cl. ..... 114/312; 114/66; 114/177

[58] Field of Search ..... 114/66, 177, 361, 312; 244/121; 52/398, 208; 296/201; 277/205, 207 R, 212 R; 428/412

[56] References Cited

U.S. PATENT DOCUMENTS

| | | | |
|---|---|---|---|
| 385,656 | 7/1888 | Belisle | 114/66 |
| 1,324,880 | 12/1919 | Cronenberg | 114/333 X |
| 2,201,249 | 5/1940 | Tormollan, Jr. | 114/66 X |
| 2,576,392 | 11/1951 | Downes | 189/64 |
| 3,240,186 | 3/1966 | Dobell | 114/66 X |
| 3,254,621 | 6/1966 | White | 114/66 |
| 3,667,415 | 6/1972 | Robbins, Jr. | 114/333 |
| 3,680,515 | 8/1972 | Yoneda et al. | 114/66 |
| 4,046,951 | 9/1977 | Stefanik | 428/412 |
| 4,081,581 | 3/1978 | LiHoll, Jr. | 428/138 |
| 4,204,374 | 5/1980 | Olson | 52/208 |
| 4,411,213 | 10/1983 | Laukien | 114/312 |
| 4,423,695 | 1/1984 | Rougerie | 114/61 |
| 4,494,472 | 1/1985 | Rougerie | 114/66 |
| 4,565,145 | 1/1986 | Mayall et al. | 114/66 |
| 4,854,256 | 8/1989 | Hayashi | 114/61 |
| 4,928,614 | 5/1990 | Forman | 114/66 |
| 4,960,631 | 10/1990 | Walters et al. | 428/152 |

FOREIGN PATENT DOCUMENTS

| | | | |
|---|---|---|---|
| 0090947 | 10/1983 | European Pat. Off. | 286/201 |
| 3029765 | 8/1980 | Fed. Rep. of Germany | 296/201 |

*Primary Examiner*—Sherman Basinger
*Attorney, Agent, or Firm*—Jack C. Munro

[57] ABSTRACT

In a semi-submersible ship, magnifying panoramic view windows are provided that are watertight, strong, highly durable, and resistant to impact and optical occlusion. A laminated transparent sheet is formed that is surrounded by a ribbed gasket. A steel frame provides uniform compression on the gasket and prevents it from extruding away from the transparent sheet. Bolts are used to attach the transparent sheet to the hull of the ship.

8 Claims, 7 Drawing Sheets

METHOD OF MAKING AND APPARATUS OF A VIEW WINDOW

REFERENCE TO PRIOR APPLICATION

The application is a continuation-in-part of patent application Ser. No. 07/697,221, filed May 7, 1991, by the title of VIEW WINDOW AND SEALING GASKET ASSEMBLY FOR A VESSEL and now abandoned.

BACKGROUND OF THE INVENTION

1) Field of the Invention

This invention relates to windows that provide high resistance to extreme changes in stress and pressure, and more particularly to windows for submersible and semi-submersible water craft.

2) Description of the Prior Art

An information disclosure statement was filed with the parent application from which this patent arose. The related art to water craft are listed as follows: U.S. Pat. No. 385,656 issued to Belisle on Jul. 3, 1888; U.S. Pat. No. 1,324,880 issued to Cronenberg on Dec. 16, 1919; U.S. Pat. No. 3,240,186 issued to Dobell on Mar. 15, 1966; U.S. Pat. No. 3,254,621 issued to White on Jun. 7, 1966; U.S. Pat. No. 3,667,415 issued to Robbins, Jr. on Jun. 6, 1972; U.S. Pat. No. 3,680,515 issued to Yoneda et al. on Aug. 1, 1972; U.S. Pat. No. 4,411,213 issued to Laukien on Oct. 25, 1983; U.S. Pat. No. 4,423,695 issued to Rougerie on Jan. 3, 1984 (Rougerie I); U.S. Pat. No. 4,494,472 issued to Rougerie on Jan. 22, 1985 (Rougerie II); U.S. Pat. No. 4,565,145 issued to Mayall et al. on Jan. 21, 1986; U.S. Pat. No. 4,854,256 issued to Hayashi on Aug. 8, 1989; and U.S. Pat. No. 4,928,614 issued to Forman on May 29, 1990.

While some of the prior art disclosed glass and acrylic windows for use on submersibles, none disclosed means by which such windows could be fabricated and attached to a ship for strength, impact, and scratch resistance while avoiding hazing and maintaining high light transmittance. Further, the prior art did not mention view windows meeting United States Coast Guard requirements when used as a replacement for part of a vessel's steel hull.

Laminated plastics per se, such as the ones used in the present invention, are known in the art and are somewhat described in materials obtained from Texstar, Inc. at P.O. Box 534036, 802 Avenue J. East in Grand Prairie, Tex., 75053.

Published materials regarding LEXAN brand of polycarbonate resin may be obtained from the General Electric Company Plastics Group at One Plastics Avenue, Pittsfield, Mass., 01201.

SUMMARY OF THE INVENTION

A water-tight viewing window for a semi-submersible ship is disclosed that is strong, resistant to fracture, scratching, fatigue, and impact. Further, the view window of this invention is the first to be approved by the United States Coast Guard as a substitute for steel in the hulls of vessels. Means by which the viewing window is attached to the submersible ship, and means by which a water and airtight seal is created and maintained, are also disclosed.

In order to provide safe viewing of underwater terrains and scenery, semi-submersible ships have been developed that can travel over the top of the water, then cruise with viewing portions submerged under the water.

To provide a wide viewing area, large, transparent panels are used as windows. These panels are constructed in a multi-layer sequence of different materials to provide strength, flexibility, scratch resistance, high clarity and magnification. Further, these panels are attached to the hull sides of the ship to provide a flexible (rather than rigid) air and water-tight seal using a flexible gasket that is compressed by an encompassing steel framework. The flexible gasket is constructed so as to provide plural seals by means of gasket ridges or ribs pressed against the framework, panel and ship's hull. Use of the disclosed flexible gasket makes construction and fitting of the view window decidedly easier. To the observer the window is concave which magnifies the view observed through the window.

Primarily, the flexible seal of this invention obtains a higher degree of vessel safety thereby reducing catastrophic losses. Unlike a rigid seal which upon impact cracks and permits the continuous entry of water, the flexible seal has the potential to shift and reseal when the impact force has dissipated, thus stopping the entry of water.

The window panel has two vertically curved LEXAN polycarbonate sheets between three sheets of urethane and two sheets of acrylic. The urethane sheets act as a bonding agent between the LEXAN and acrylic layers. The edge of the panel is coated with an ambient sealing coating and is also surrounded by a water-tight, ribbed gasket as added protection for the LEXAN from exposure to sea water plus allow for expansion and contraction. An "L" shape steel frame is placed over the gasket and window assembly to provide protection for the gasket and to act as a gasket retainer once the gasket and window assembly is retained in position and the bolts are torqued down. Since the gasket will endeavor to extrude into any open space when compressed, the frame is designed so as to force the gasket to extrude toward the center of the window thereby creating a more effective seal.

The complete assembly is placed in position over an open cut-out in the ship's hull. Bolts are used to secure the assembly in place. Within the first embodiment of window panel sealing structure, the bolts are conducted through the frame, gasket and window panel into the hull. To protect against water entering through the bolt holes in this first embodiment, the bolt holes in the rubber gasket are cut undersize to act as a seal against the bolt. Back-up O-rings, rubber/metal seal washers, or weld tight cap nuts may also be employed as a reinforcement against water entering through the bolt holes. In the second embodiment of window panel sealing structure, the bolts are not conducted through the gasket and window panel thereby further minimizing contamination of the window panel by ambient water and/or salt.

After initial fitting, the bolt heads may be welded to the steel framework. Adjustment of the bolt pressure upon the assembly may be controlled by the bolt nuts located interiorly of the ship's hull and/or the bolt heads (if not welded).

The U-shaped gasket contains two or three ribs on each of four surfaces. These ribs are continuous and circumscribe the entire gasket such that when the ribs are placed against any flat surface, they automatically form a closed continuous air and water-tight cavity along the perimeter of the flat surface.

This specially designed cavity serves as an air and water-tight window panel seal. It also serves as a cavity which can be pressurized with air to facilitate verifying the integrity of the window seals before the vessel is placed in the water. To test for leaks, a hollow tube-like probe is placed between a rib and the flat surface. Compressed air is injected into the cavity until a desired pressure is obtained. LEAK TEC (manufactured by American Gas & Chemical Company, Ltd. of Northvale, N.J.) solution is then sprayed along the entire seal joint and the test article is observed for bubbles as an indication of a leak. If no leaks are detected, the probe is removed after the pressure is released. This technique has the capability of detecting the leakage of one liquid ounce of Freon in 170 years. The rib design of the gasket provides a positive water-tight window panel seal before the vessel is placed in the water. Means for testing the seal before placing the vessel in the water is of great concern because the leakage of any amount of sea water would severely damage the vessel interior.

The view window herein disclosed has been approved for use in vessels by the United States Coast Guard. The view window avoids use of distracting and view-limiting steel fenders. Normally, such steel fenders would be required to circumscribe the vessel at eye-view window level in order to assure hull integrity. As the view window included within this invention is stronger than steel, the hull itself would collapse upon impact before breaking of a view window.

OBJECTS OF THE INVENTION

It is an object of this invention to provide a water-tight, below surface of the water, viewing chamber within a ship by which underwater scenes may be viewed.

It is also an object of this invention to provide underwater viewing windows in a ship that are strong and resistant to impact and fatigue.

It is another object of this invention to provide a ship that has an underwater viewing chamber that minimizes claustrophobic feelings to the viewers.

It is another object of this invention to provide a ship with underwater viewing windows that meet United States Coast Guard requirements so that no steel fenders need to be used to assure hull integrity.

It is yet another object of this invention to provide a ship with underwater viewing windows that are essentially free of leaks with seal integrity capable of being verified prior to locating of the ship in the water.

Another object of this invention is to provide an underwater viewing window which magnifies the view that is observe through the window.

DESCRIPTION OF THE PREFERRED EMBODIMENT

Figure 1:
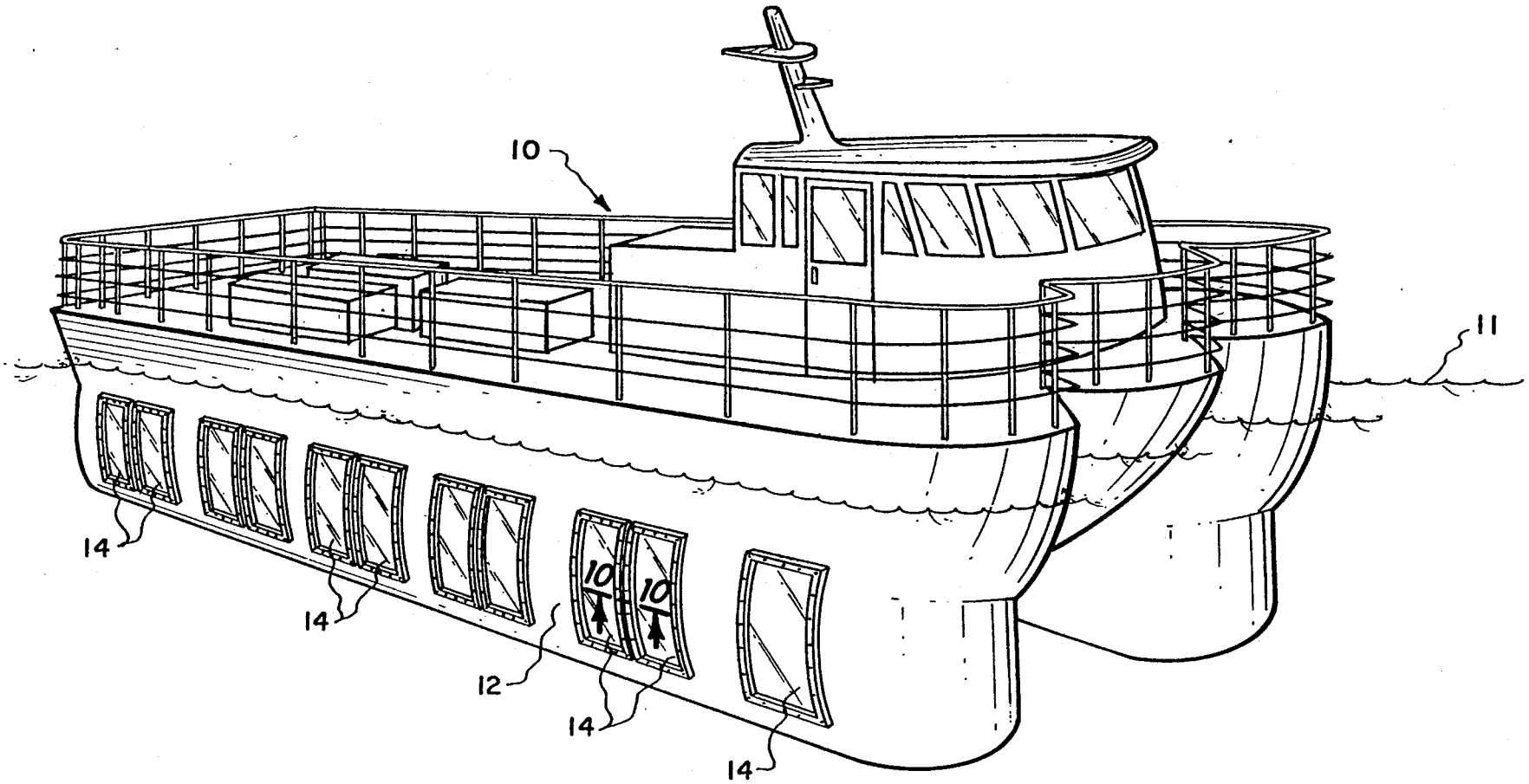
FIG. 1 depicts a semi-submersible ship incorporating the view window of the present invention.

Referring to FIG. 1, the preferred embodiment of a semi-submersible ship 10 is portrayed in water 11. The ship has a dual hull 12 that incorporates eleven (in number) of view windows 14 of the present invention within the port side and eleven view windows 14 in the starboard side of the hull 12. The ship 10 is capable of faster travel with view windows 14 riding above the surface of the water 11, and slower travel with the view windows 14 below the surface of the water 11. The ship 10 may take on ballast (such as water) to attain a desired submerged depth, thereby providing a variable and more extensive view through windows 14 of the underwater seascape. This ballast is to be cast off in order to travel faster.

Figure 2:
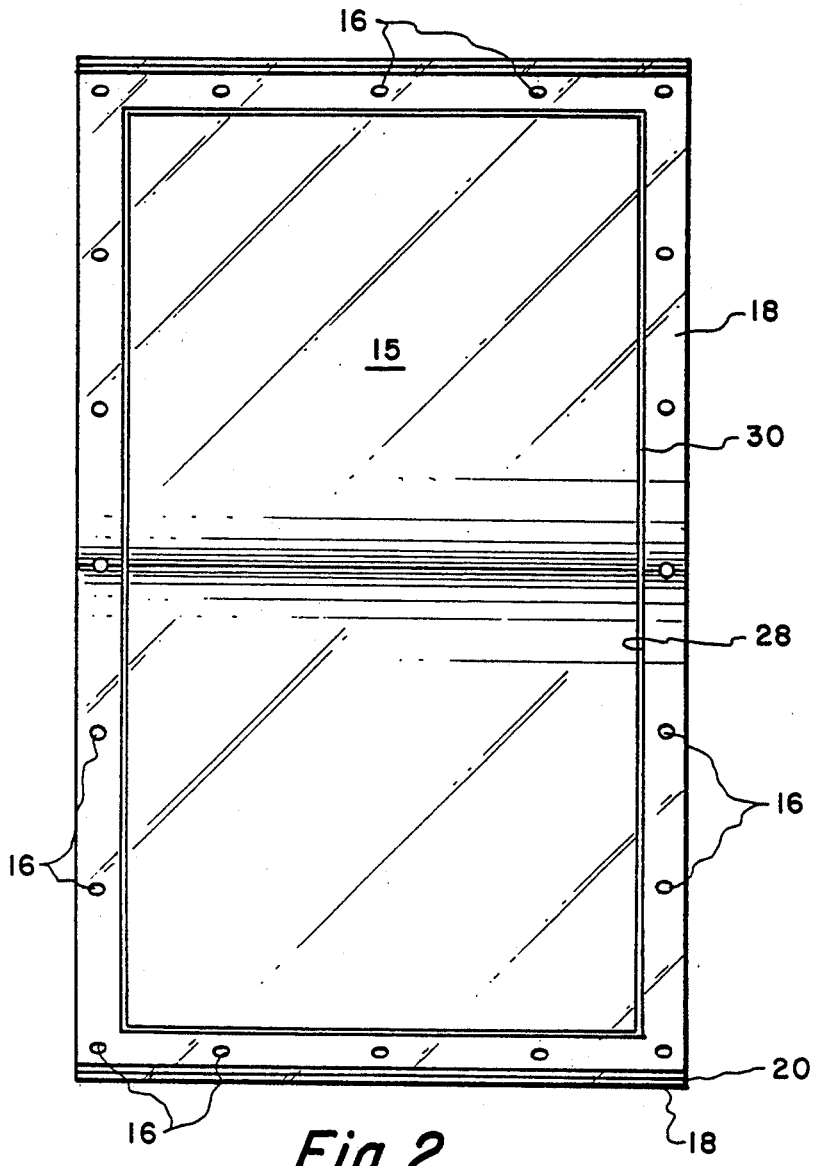
FIG. 2 is a view of the view window (including frame) from the interior of the hull of the ship.
Figure 3:
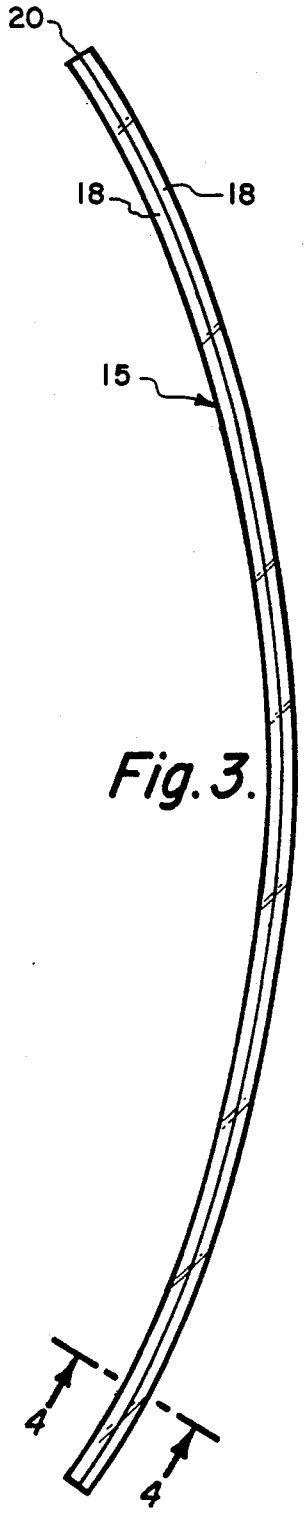
FIG. 3 is a side view showing the curvature of the transparent panel of the window of FIG. 2 without the frame.
Figure 4:
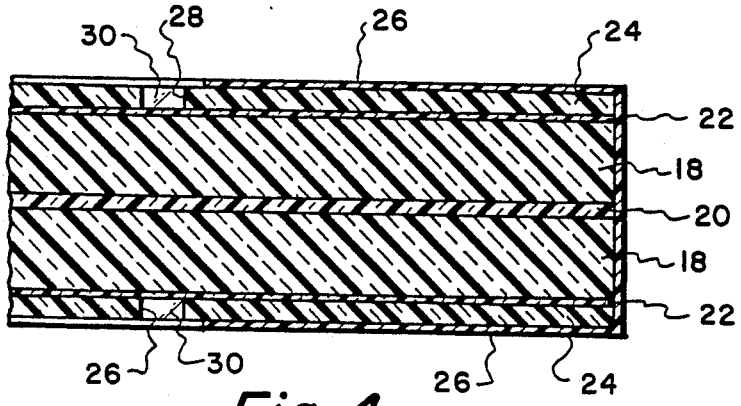
FIG. 4 is a cross-sectional view through the transparent panel taken along line 4—4 of FIG. 3.

Referring to FIGS. 2–10, the first embodiment of view window 14 is shown broken down into its major components. FIGS. 2–4 show the transparent panel 15 used within the view window 14. The panel 15 is curved to conform with the lower exterior hull 12 of the ship 10 with this curving being concave to an observer located within the hull 12. A plurality of spaced apart (substantially evenly) through holes 16 are formed in the panel 15 directly adjacent to the periphery of panel 15. Normally, these through holes 16 are placed in the panel 15 after the panel 15 is formed.

Referring to FIG. 4, the majority of the material used in the panel 15 is a polycarbonate manufactured by General Electric Corp. and sold under the tradename of LEXAN. Two large LEXAN sheets 18 are used each of which are 0.530 inches thick. Between the two LEXAN sheets 18, there is located a layer of urethane 20 that is 0.050 inches thick. The outer surfaces of both the LEXAN sheets 18 are then covered with a layer of urethane 22 that is 0.025 inches thick. Layers of acrylic 24 that are 0.125 inches thick are placed on the outside of both urethane layers 22. It is to be understood that the area encompassed by sheets 18, urethane layer 20, urethane layers 22 and acrylic layer 24 is all identical with each layer being the same size as sheets 18. It is possible to construct the panel 15 with only layer 24 being on the convex (exterior) surface of panel 15. On the concave (interior) surface of panel 15 there could be used another type of protective layer such as glass.

Placed on and surrounding the perimeter area of the panel 15 is a barrier coating 26 of epoxy paint. The coating 26 protects the cut edges of the panel 15, especially the edges of the LEXAN. LEXAN is strong but can react with surrounding substances in a manner that is detrimental to its visual and strength qualities.

The panel 15 has dimensions of thirty-five inches by fifty-seven inches. The vertical curvature is uniform and has a radius of 54.5 inches. A through hole 16 is present in each corner of the panel 15 and every nine inches along the edge of the panel. The through holes 16 are 1¼ inches from the edge of the panel 15 and are 0.625 inches in diameter.

A stop crack groove 28 is present in each of the acrylic layers 24. The stop crack groove 28 is 2½ inches away from the edge of the panel 15 and is ¼ inch wide and 0.125 inches deep. The stop crack groove 28 serves to protect the brittle acrylic layer 24 from spreading cracks created along the edges of the panel 15 near the through holes 16. The stop crack groove 28 is filled with flexible silicone rubber 30 to fill the void and provide a smooth transitional surface. The entire panel 15 is 1.4 inches thick.

Figure 5:
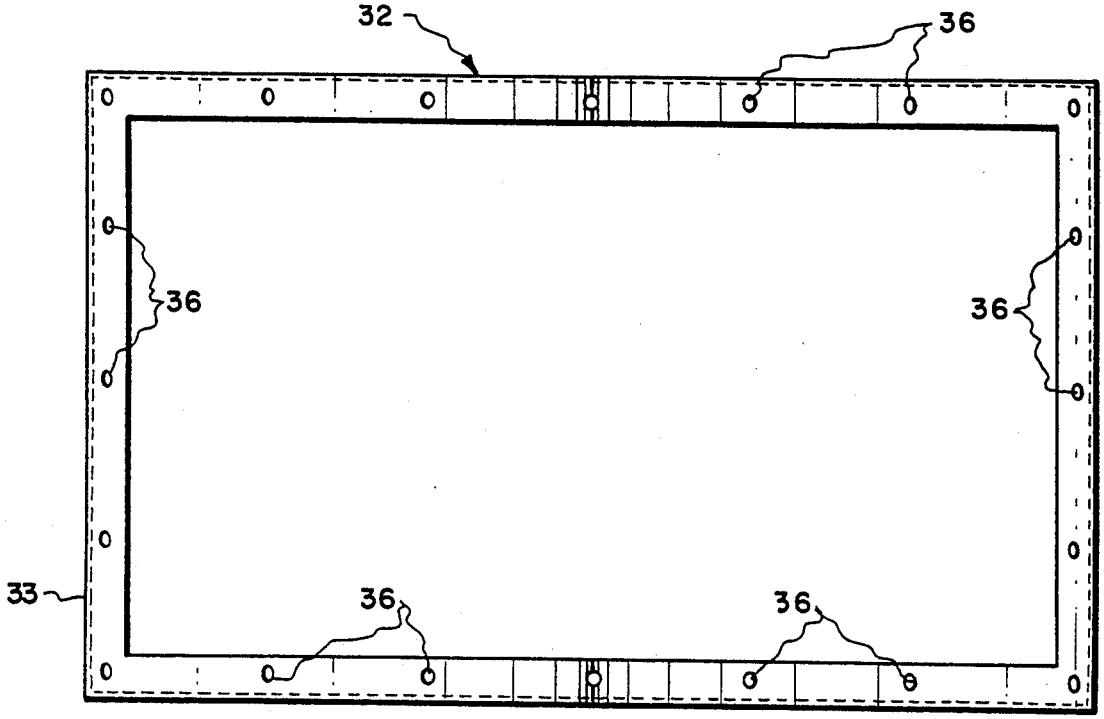
FIG. 5 is an exterior view of the window (including frame) of the present invention.
Figure 6:
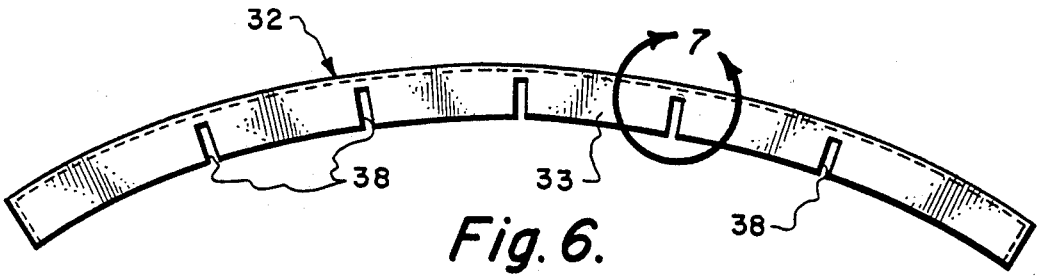
FIG. 6 is a side view of the steel frame of FIG. 5 showing one way of construction for the frame.
Figure 7:
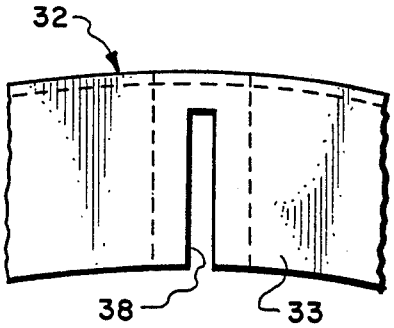
FIG. 7 is an enlargement of a portion of FIG. 6 taken generally along encircled portion 7.

FIGS. 5–7 show the steel frame 32 which acts as a compression and support member for the panel 15 and gasket 40. The steel frame 32 is 0.187 inches thick and corresponds to ASTM No. A-36 structural steel or equivalent. The steel frame 32 covers the perimeter of the panel 15 with a perimeter overlap of three inches in width. The steel frame 32 is 59.36 inches long from inside corner to inside corner and 35.50 inches wide from inside corner to inside corner. The use of "inside corner" herein refers to the corner inside the frame 32, not accounting for material thickness, and is a measure of available space provided by the frame 32.

Bolt holes 36 are present corresponding to through holes 16 present in the panel 15. For the steel frame 32, the bolt holes 36 are 1.375 inches from the edges of the frame 32. The steel frame 32 is curved along the vertical or long axis to conform to the panel 15 and also to conform with the shape of the ship's hull 12. The steel frame 32 has an outside radius of curvature of 56.2 inches and an inner radius of curvature of 54.4 inches.

Ten in number of evenly spaced apart slots 38 are formed within the inside surface of frame 32 which correspond to the ten vertical bolt holes 36. The slots 38 are 1.56 inches deep and ⅛ inch wide. The slots 38 allow the steel frame 32 to be slightly flexed open so that the panel 15 bearing its gasket 40 may be inserted into the steel frame 32. The interior portion of the steel frame 32 is a smooth, uniform curve. The steel frame 32 is painted before assembly to provide resistance to corrosion.

Figure 8:
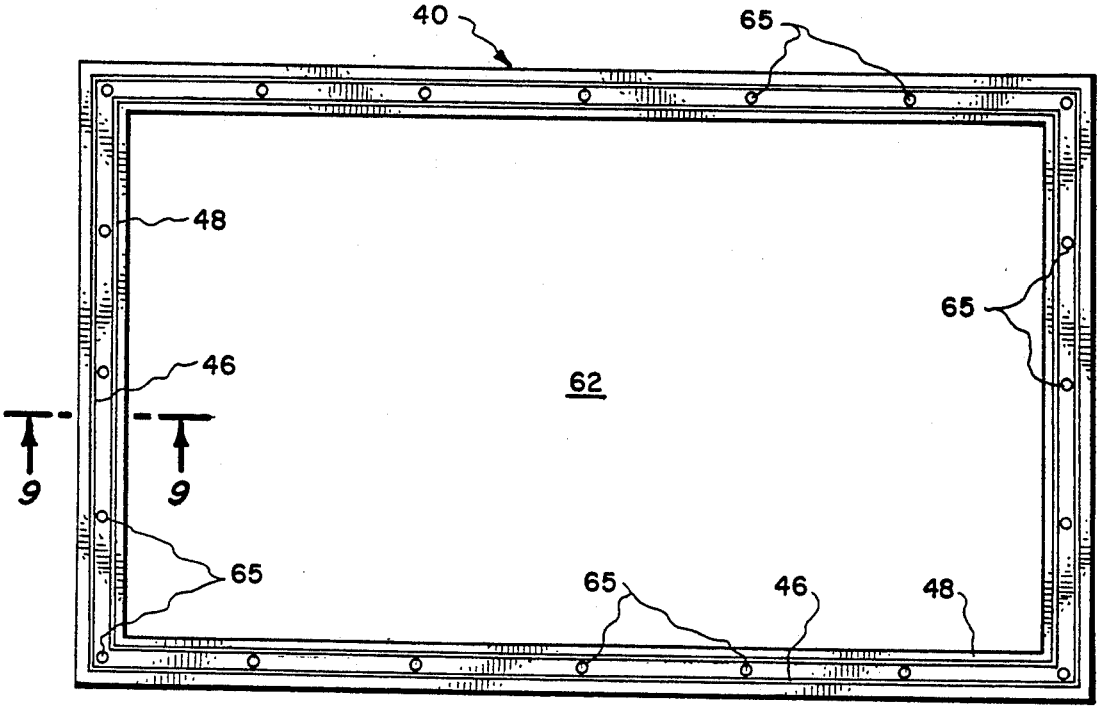
FIG. 8 is a top plan view of the ribbed gasket used within the present invention with the bottom plan view being also identical.
Figure 9:
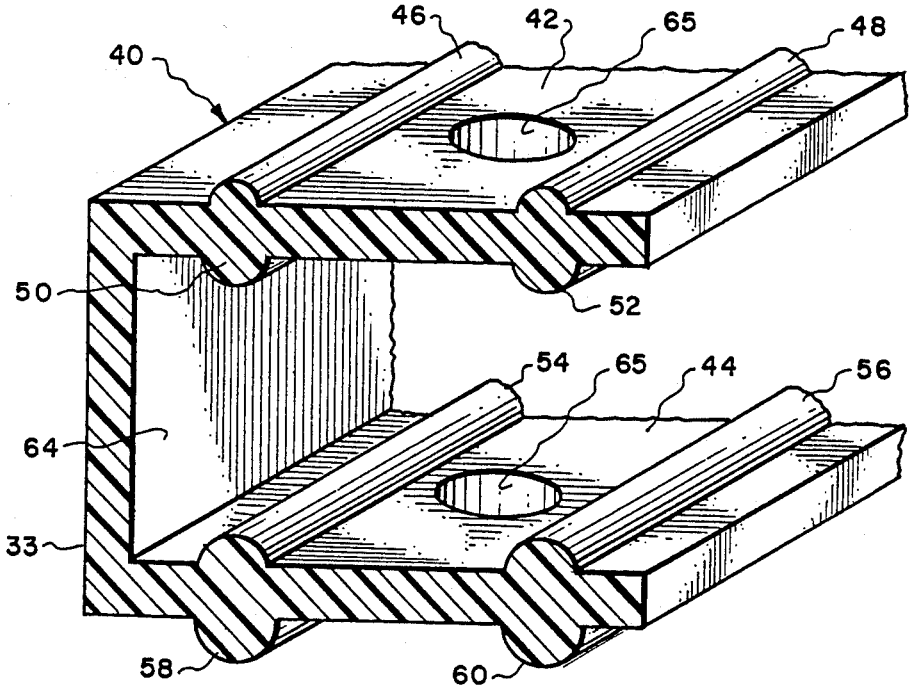
FIG. 9 is a sectional view, in perspective, of the ribbed gasket taken generally along line 9—9 of FIG. 8.

FIGS. 8 and 9 show the gasket 40 of the present invention. The ribbed gasket 40 is of special design and provides a positive seal against external water pressure and the impact of objects against panel 15 within reasonable limits. The gasket 40 is fitted around the panel 15. The gasket 40 is made in one extruded length which is then cut to desired lengths with each desired length comprising a side of the gasket 40. After forming the frame of the gasket, the cut lengths forming the sides are bonded by vulcanization and cement at the corners.

The ribbed gasket 40 provides a dual seal at each surface interface with each seal being provided by a rib/surface contact. The ribs 46 and 48 permit tolerance of variances and non-uniformities between the frame 32 and the hull 12 while maintaining a watertight seal. The flexibility of the gasket 40 is maintained while in use which allows it to absorb some impact while maintaining the seal. The steel frame 32 provides uniform compression of the gasket 40.

The gasket 40 surrounds the perimeter of the panel 15 and is made of elastomeric material such as neoprene, hydrin, or some form of compressible plastic with a stable resilience which measures 50–55 shore "A" on a durometer. The gasket 40 is formed in a U-shape, with the leg 42 of the "U" having four ribs 46, 48, 50 and 52, and leg 44 having four ribs 54, 56, 58, 60. Two ribs on each leg 42 and 44 are on the outside of the leg and two ribs on each leg 42 and 44 are on the inside of the leg. The gasket 40, save for the ribs, is 0.2 inches thick, is formed to frame 32 and to encompass the panel 15.

The space 62 enclosed by the gasket 40 measures fifty-seven inches long by thirty-five inches wide. The corners of the gasket are joined at ninety degrees formed from two forty-five degree mitered edges. The corners are completely sealed and are bonded by vulcanization and cement to ensure a water-tight seal. Heat sealing or ultrasonic welding of the gasket may also be possible. After the corners of the gasket 40 are bonded, additional sealant is added to the inside cut surfaces for additional assurance of a water-tight seal.

Each leg 42 and 44 of the gasket 40 is 2.825 inches long at its outside surface, with the base 64 being 1.9 inches wide on its exterior surface. Both measurements include the width of the gasket material. The inside area of the gasket 40 has legs with a length of 2.625 inches and a base of 1.5 inches.

Referring to FIG. 9, ribs 46, 50, 54, and 58 are in alignment as are ribs 48, 52, 56, and 60. The top ribs 46 and 48 have a radius of 0.14 inches. The inner ribs 50, 52, 54, 56 have a radius of 0.156 inches. The bottom ribs 58, 60 have a radius of 0.203 inches. All the ribs 46, 48, 50, 52, 54, 56, 58, 60 extend continuously along the entire gasket.

When fitted over the panel 15 and held in place by the steel frame 32, the top ribs 46, 48 underlie the steel frame 32; the inner ribs 50, 52, 54, 56 lie along the top and bottom of the panel 15 with the gasket base 64 located against the side edge of panel 15; and the bottom ribs 58, 60 are in contact with the hull 12 of the ship 10. Holes 65 in gasket 40 correspond to through holes 16 in the panel 15 and bolt hole 36 in the frame 32.

Figure 10:
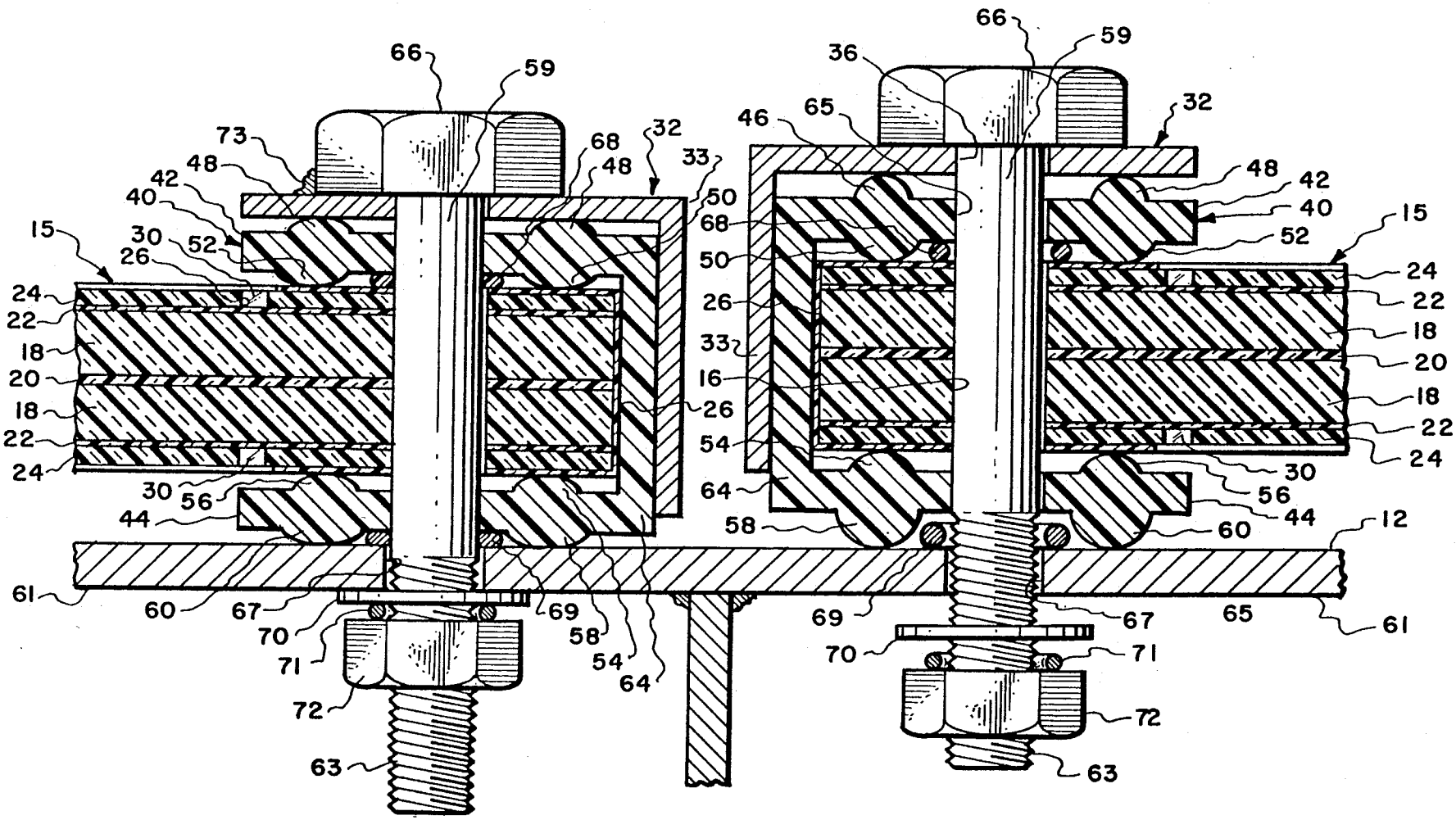
FIG. 10 is a sectional view taken along line 10—10 of FIG. 1 of the first embodiment of view window of this invention.
Figure 11:
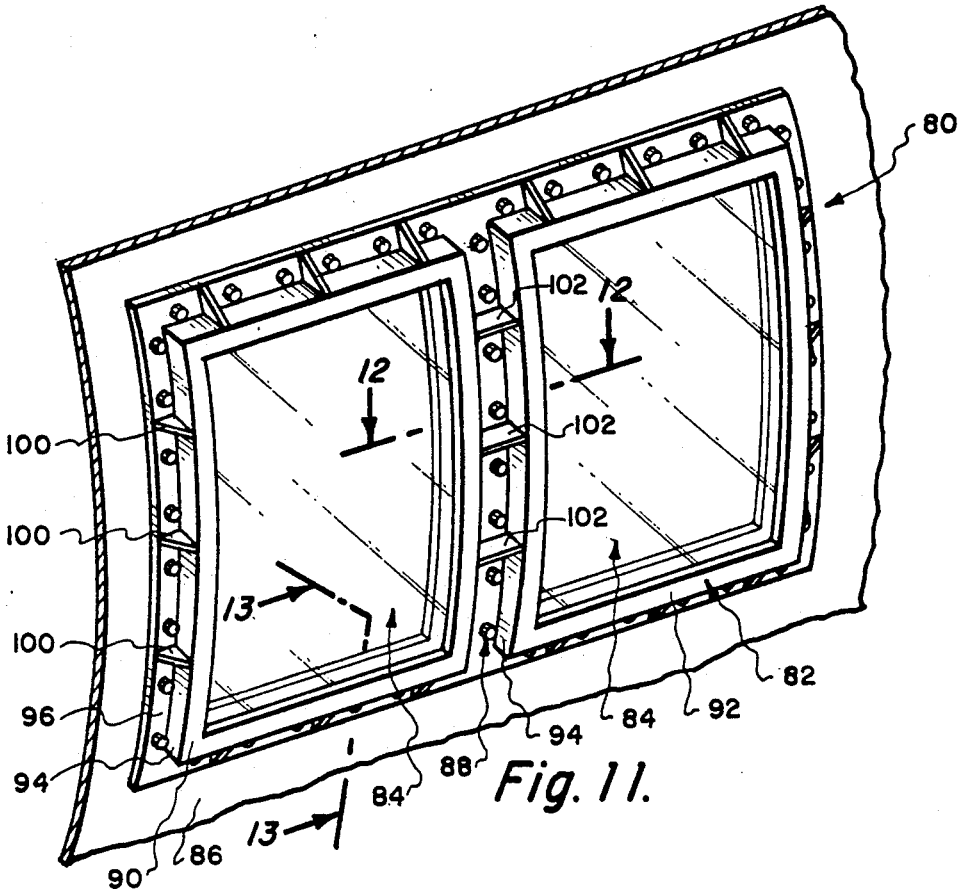
FIG. 11 is an exterior view of a second embodiment of view window of this invention showing the window mounted in the hull of the ship.

As can be seen in FIG. 10, bolts 66 are shown holding together the steel frame 32, gasket 40, and panel 15 to make up a view window 14. The closest clearance between two adjacent frames 32 is 0.54 inches. A bolt 66 with a smooth, round shaft is inserted through a bolt hole 36 of the steel frame 32. The bolt 66 also fits through an aligned pair of holes 65 of the gasket 40, the flexible O-ring 68, a hole 16 of the panel 15, another flexible O-ring 69, a hole 67 in the ship's hull 12, a flat washer 70, a split lock washer 71 and finally a nut 72. Upon initial tightening of the nut 72, the head of the bolt 66 presses down upon frame 32. The leg 42 of the gasket 40 is compressed between the steel frame 32 and the panel 15. The leg 44 of the gasket 40 is compressed between the side of the hull 12 and the panel 15.

As an alternative to O-rings 68 and 69, rubber/metal seal washers (not shown) can be used as replacement if water leakage occurs along the body of bolt 66.

The compression of the gasket 40 around the panel 15 forms water-tight seals where the ribs 46, 48, 50, 52, 54, 56, 58, 60 engage the steel frame 32, the panel 15 and the hull 12. The base 64 of the gasket 40 is contained by the side 33 of the steel frame 32. O-rings 68 and 69 are compressed by the gasket 40 which is compressed by the nut 72. Preferably, when the entire view window is completely installed, the threads 63 of bolt 66 sit halfway into the plate of hull 12 so O-ring 69 provides a seal around the smooth round surface of the body 59 of the bolt 66 rather than around the irregular surface of the bolt threads 63.

The O-rings 68 and 69 serve as the primary seal to prevent water seepage or leakage along the shoulder or through the threads 63 of the bolt 66 and into the interior compartment 61 of the hull 12 of the vessel. Although the O-rings 68 and 69 provide the primary seal against water leakage, the gasket holes 65 are cut significantly smaller in diameter such that these holes 65 squeeze around the body 59 of bolt 66 to act as a secondary seal.

If the O-rings 68 and 69 (or the rubber/metal washers) are not effective in sealing against leaks, then "cap" nuts (not shown) can be welded around all holes 67 in the hull 12. Flange angle plates (not shown) can also be welded to the hull 12 to provide a positive seal against leakage. It can be seen that several means exist by which a positive seal against leakage may be provided and that the present invention is not strictly limited to those explicitly set forth here.

While in dry dock, the view windows 14 are fitted onto the hull 12. Prior to torquing the bolts 66, the bolt heads are welded by weld 73 so that torquing of the nut 72 from inside the hull 12 does not rotate the head of bolt 66 which would prevent application or release of pressure. This allows the view windows 14 to be adjusted without having to take the ship 10 out of the water 11 or having to send a diver over the side to restrain the heads of bolts 66.

Using large transparent panels 15 as panoramic view windows allows passengers to face port and starboard to see underwater scenes such as coral reefs, varieties of fish, plant, and invertebrate life, and the activities of marine mammals such as whales, dolphins, seals, and sea otters. Kelp beds or at least the top fronds may also be viewed. The use of laminated polycarbonates instead of glass or acrylic permits the use of a panoramic size window while maintaining greater structural integrity. Both glass and acrylic windows, while non-reactive in the ocean, are brittle and subject to fracture and catastrophic failure.

One inch thick LEXAN polycarbonate has impact and tear strengths exceeding that of ASTM A-36 structural steel. Further, optical clarity and transmission are preserved despite the great strength of LEXAN. The use of LEXAN, rather than the use of acrylic, presents less of a risk to passengers by better maintaining its structural integrity when subjected to impact or stress. A semi-submersible ship equipped with LEXAN viewing windows of the present invention may better withstand the assaults of time and tide without decreased performance. Impacts such as accidental collisions with coral reefs and other stresses will be better sustained by the flexible seals and the viewing window without suffering material failure or rupture normal for hard, rigid seals and other types of windows.

The fabrication of laminated LEXAN sheets is known in the art and LEXAN itself is a well-known and widely used material. However, despite this and as is reflected by the prior art, use of LEXAN in viewing windows for semi-submersible vessels has not before been attempted or achieved. The use of laminated polycarbonate is preferred because exposure of LEXAN to salt water generates a fog or haze on the surface of the LEXAN destroying the optical clarity of the sheet.

To make a laminated material such as the one used here for view windows 14 in a semi-submersible ship, the materials to be incorporated into the laminated material are first carefully screened for scratches, bubbles, blisters, particles internally embedded in the material, cracks, fractures, or other defects. Sheets that are adequate for use by visual and tactile inspection are washed in a lukewarm solution of mild soap with a soft sponge, then rinsed in warm, clean water. As the sheets are hung vertically, they are then dried in an oven that circulates air at 250 degrees Fahrenheit. This oven drying step removes both residual water remaining from the wash as well as moisture absorbed by the material itself from the air. All moisture and every particle of dirt are removed before the sheets are laminated together. The sheets are maintained in their clean and dry state by performing all operations in a pressurized room environment to prevent particles from collecting on the sheets.

After cleaning and drying the sheets, the polycarbonate and acrylic layers are stacked upon each other using sheets of urethane as a bonding agent. Other types of bonding agents may be used. However, while urethane requires greater preparation and curing, it provides the most flexible, impact resistant bond with high optical clarity, as well as high peel and lap shear strength. Further, urethane provides a 100% reactive solid as it contains no solvents, does not stress craze the polycarbonate, and provides a medium that relieves the stress experienced between dissimilar materials with different coefficients of thermal expansion. That is, the different materials expand and contract differently with different temperatures and the urethane layer mediates these differences. Urethane also does not creep fatigue and cures fully at room temperature after undergoing the heating required for lamination.

The unfused laminate sheet of polycarbonate, acrylic, and urethane is placed on a hollow steel support. The edges around the perimeter are bound with a porous plastic mesh, then covered with a mylar film. A metal vacuum pipe is incorporated in the mylar film. The mylar film is then sealed to the top and bottom sheet of the stack.

After the mylar sheet is sealed to the top and bottom sheets, an ultra-high vacuum pumping system is attached to the vacuum pipe to subject the laminate to four or five days of ultra-high vacuum on the order to $10^{-8}$ millimeters of mercury (mm Hg). This removes microscopic particles of water or gasses and causes the laminate sheets to virtually generate a molecular bond.

After the laminate has been subjected to the vacuum for a sufficient time, the stack is then placed in a large autoclave. The vacuum is maintained on the laminate during autoclaving. The autoclave is sealed and the laminate is then subjected to high temperature and pressure on the order of 250 degrees Fahrenheit and 250 psi. Heat is uniformly distributed over the laminate and is controlled by infra-red sensors. As the temperature increases, the pressure and vacuum draw out all remaining gasses, eliminating any potential of internal bubbles. A fused laminate of ultimate clarity is thereby achieved.

After autoclaving for a sufficient time, the laminate is gradually cooled until it reaches room temperature. The laminate is then inspected for defects. If satisfactory, the laminate is cut to the size required for the view windows 14. After cutting, the flat sheet is placed in a heated forming fixture in order to properly curve the sheet to match the ship's hull. After forming, the curved view window blank has holes 16 drilled into it (if used), has its edges polished, and a "cut-edge barrier protective coating" is applied to prevent exposure of the polycarbonate layers to the elements.

The stop crack groove 28 is engraved in the sheet 15 and serves to protect the brittle acrylic layer 24 from perpetuating any cracks into the transparent viewing area of the window 14. Such cracks may be generated in the perimeter when excessive bolting pressure is applied at the through holes 16 causing the 0.125 inch acrylic layer 24 to fracture.

The LEXAN will not crack and since the stop crack groove 28 is present, any crack can only perpetuate to the extremes of this stop crack barrier 28, thus preserving and protecting the transparent viewing area of the window 14. Effectively, the stop crack groove circumscribes both sides of the window to provide a 2½ inch wide peripheral island for bolting pressure and isolation of stress. After the stop crack groove 28 is filled with flexible silicone rubber 30, the view window sheet 15 is then ready to be fitted with gasket 40, placed onto the ship's hull and bolted in place by the steel frame 32.

Referring particularly to FIGS. 11 to 14 of the drawings, there is shown a second embodiment 80 of view window of this invention. The second embodiment 80 is to be constructed of a frame 82 which is of a size to encompass two in number of window viewing panels 84 located in a side-by-side relationship. Each of the panels 84 are constructed in precisely the same way as previously described in relation to the transparent panel 15. The difference of the frame 80 versus the frame 32 is that a single frame 80 encompasses two panels 84 where the frame 32 encompasses only a single panel 15. The frame 80 would be mounted between the two view windows such as is shown in relation to FIG. 10. The frame 82 is to be fixedly mounted on the hull 86 by means of bolts 88 which are essentially identical to bolts 66 previously described. However, bolts 88 more than likely will not be welded to the hull 86. Associated with each bolt 88 will be appropriate washers that are deemed to be conventional.

The frame 82 defines a pair of border frames 90 and 92. The border frames 90 and 92 are located in a side-by-side relationship with border frame 90 having mounted therein a panel 84 with a second panel 84 being mounted within border frame 92. Both border frames 90 and 92 are essentially identical with similar numbers being utilized to refer to the same parts of both border frames 90 and 92.

Each of the border frames 90 and 92 define an outer section to which is integrally connected to a vertical section 94. Integrally connected to the bottom or lower edge of the vertical section 94 is a mounting flange 96. It is within the mounting flange 96 that there are located the bolt holes 98 which are to connect to the bolts 88. The mounting flange 96 is to be fixedly mounted by the bolts 98 in position on the hull 86.

All the way along each of the border frames 90 and 92 there is located stiffening plates 100 interconnecting the mounting flange 96 and the sidewall 94. It is the function of the stiffening plates 100 to prevent deflection between mounting flange 96 and the sidewall 94.

In between the border frames 90 and 92 there is a recessed area which is part of the mounting flange 96. A single row of bolts 88 function to secure both the right edge of the border frame 90 and the left edge of the border frame 92. In this area between the border frames 90 and 92 there are located a plurality of spaced apart stiffening plates 102 which are basically rectangular in configuration where the stiffening plates 100 are basically triangular in configuration.

Placed around the edge of each of the panels 84 is a gasket 104. The gasket 104 is basically similar to gasket 40 except there are three (in number) of bulbous ridges 106 associated with leg 108 instead of the four (in number) associated with gasket 40. A similar grouping of three (in number) of bulbous ridges 110 are integrally formed in conjunction with the leg 112 of the gasket 104. Interconnecting legs 108 and 112 is a base section 114.

It is the function of the bulbous ridges 106 and 110 to function similar to ribs 46, 48, 50, 52, 54, 56, 58 and 60 of gasket 40. The bulbous ridges 106 and 110 extend entirely around the gasket 104 in the same manner of the aforementioned ribs. The basic overall configuration of the gasket 104 is similar to gasket 40 except there are no openings 65 for the bolts since the bolts 88 do not extend through the gasket 104 or through any portion of the panel 84.

Figure 12:
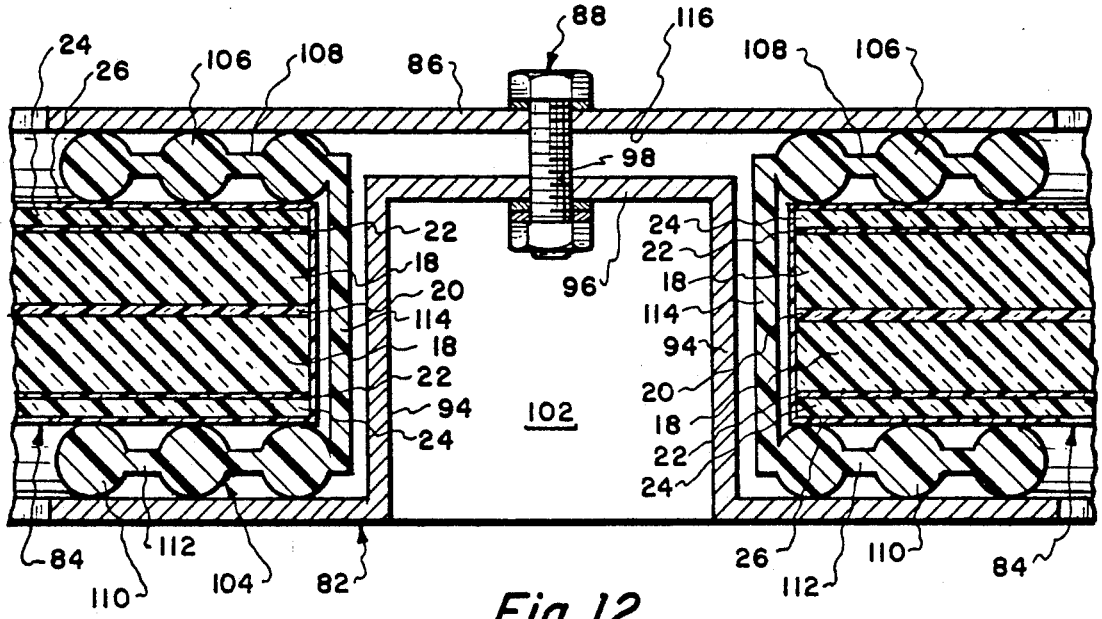
FIG. 12 is a cross-sectional view taken along line 12—12 of FIG. 11 showing more clearly the hull configuration between directly adjacent view windows.
Figure 13:
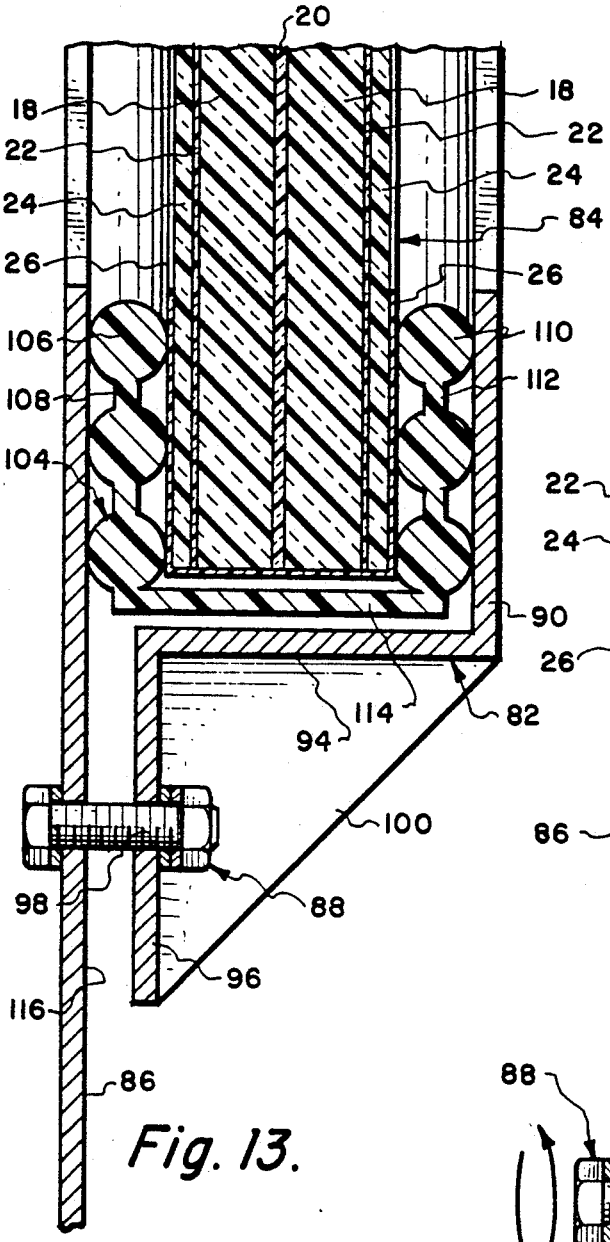
FIG. 13 is a cross-sectional view taken along line 13—13 of FIG. 11 showing the mounting arrangement for the transparent panel of the view window of the second embodiment with the securing bolts not tightened and the gasket expanded.
Figure 14:
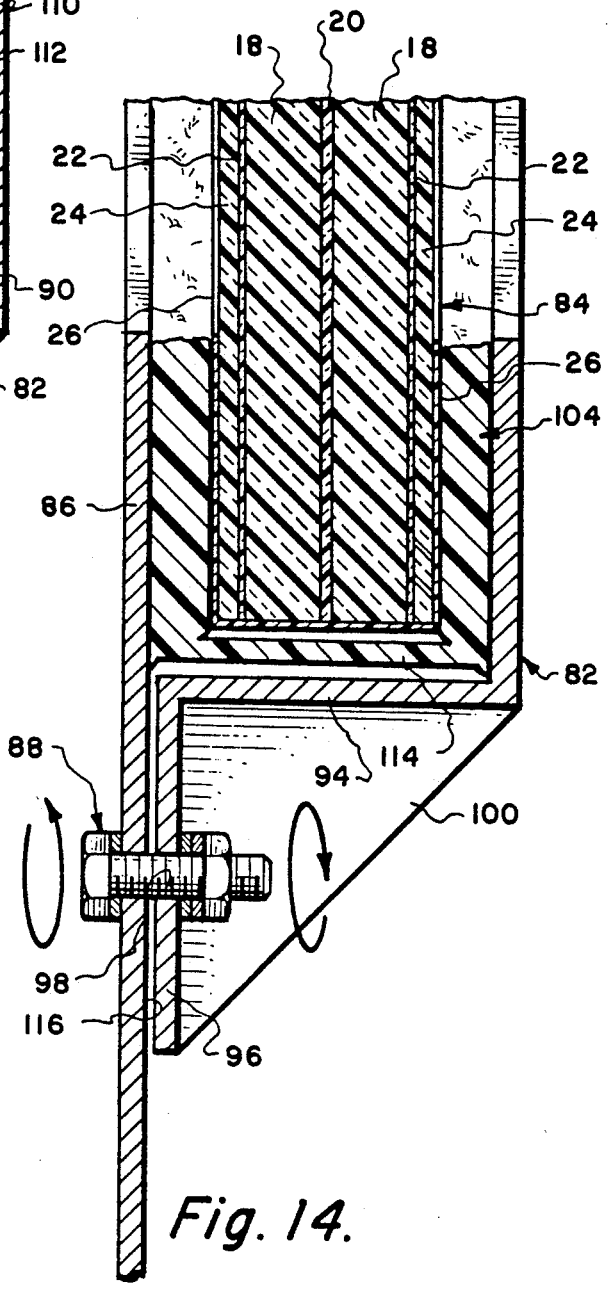
FIG. 14 is a cross-sectional view similar to FIG. 12 with the securing bolts tightened and the gasket compressed.

With the panels 84 so installed, the frame 82 is located in position and the gasket 104 is still in its expanded state and bolts 88 have not been tightened. This configuration is shown in FIGS. 12 and 13 of the drawings. However, as the bolts 88 are tightened, the gap area 116 between the mounting flange 96 and the hull 86 is lessened (narrowed) to where the mounting flange 96 almost comes into contact with the hull 86 when the bolts 88 are completely tightened. In this completely tightened position the gasket 104 is squeezed to such an extent that it almost completely fills the void between the panel 84 and the hull 86 and the panel 84 and the border frame 90 or 92. This position is clearly shown within FIG. 14 of the drawings. Even though the gasket 104 is essentially squeezed into a solid mass, there still will exist three lines of pressure being applied in co junction with each leg 108 and 112 to provide three lines of sealing between the panel 84, hull 86 and its respective border frame 90 or 92. During times of thermal expansion of the panels 84, the panels are free to move a limited amount within each of its respective border frame 90 and 92. This amount of movement for thermal expansion is absolutely necessary since the ship will be operating in both cold water and hot waters and may in a single mission move within waters of substantially different temperatures.

An important factor of both the first and second embodiments of view window within this invention is that the windows are curved outwardly (away from the hull) of the vessel on a fifty-four inch radius. The center of the radius is located at approximately eye level for a human being located in a seated position inside of the window. This provides the seated human with a large curved ninety degree panoramic view, forty-five degrees above a plane that is parallel to the surface of the water and forty-five degrees below that same plane. The result is that by using the view window constructed in accordance with this invention in conjunction with the ship, a theatre-like seating is provided where the passengers face the port and starboard sides of the vessel and are able to obtain an unobstructed panoramic view of the ocean. An additional advantage of the window of the present invention is that it magnifies and significantly magnifies. Parts of the sea floor that are several feet from the hull of the vessel are brought clearly in view giving the appearance that such parts are quite close when, in fact, are not. The method of constructing the window of the present invention maximizes the optical qualities of the window which permits the achieving of the clear, unobstructed view.

The view window of the present invention is designed to be used in an underwater environment, to be used within a vehicle that moves at a slow rate of speed, is designed to provide a panoramic view to an observer, to magnify to the observer and to be as same as possible. It is known that within the prior art substantial effort has been expended in constructing aircraft windshields which are constructed in a similar manner. However, the problems in conjunction with an aircraft windshield is that the vehicle is moving at a very rapid rate of speed and therefore an exceedingly positive, strong, high strength securing window mounting arrangement must be utilized which is not necessary within the present invention. Also, aircraft windows are not intended to magnify. Still further, aircraft windows are not intended to give a wide as possible panoramic view. Additionally, the salt water environment encountered by the window of the present invention is potentially substantially more damaging to any plastic type of window with such a damaging environment not being encountered by aircraft.

What is claimed:

1. A watertight view window for a ship comprising:

a laminated transparent sheet, said laminated transparent sheet conforming to a portion of said ship and comprising:

a top acrylic layer approximately 0.125 inches thick;

a first urethane layer approximately 0.025 inches thick;

a first polycarbonate layer approximately 0.53 inches thick;

a second urethane layer approximately 0.05 inches thick;

a second polycarbonate layer approximately 0.53 inches thick;

a third urethane layer approximately 0.025 inches thick; and a second acrylic layer approximately 0.125 inches thick;

a gasket, said gasket being U-shaped defining a pair of spaced apart legs, each said leg having an outside surface and an inside surface, an inside area formed between said inside surfaces of said legs, said gasket encompassing the perimeter of said laminated sheet with said perimeter located within said inside area, said gasket comprising:

compressible rubber or plastic which measures approximately 50–55 shore "A" on a durometer;

two ribs on said outside surface and two ribs on said inside surface of each said leg;

said ribs on a first side of said gasket having a radius of approximately 0.14 inches;

said ribs on second and third sides of said gasket having a radius of approximately 0.156 inches; and said ribs on a fourth side of said gasket having a radius of approximately 0.203 inches; and a frame, said frame conforming to a portion of said ship and overlying said gasket and encompassing said transparent sheet, said frame comprising:

ASTM A-36 structural steel or its equivalent;

an inside width of approximately 35.5 inches, an inside length of approximately 59.36 inches, and an overlap of approximately 3 inches;

said frame defining slots to provide flexibility, said slots approximately an eighth of an inch wide and approximately 1.56 inches deep;

an inside radius of curvature of approximately 54.4 inches and an outside radius of curvature of approximately 56.2 inches; and said transparent sheet attached over an opening defined by said ship, whereby a watertight view window is provided.

2. A method for providing watertight view windows in a ship comprising the steps of:

providing a laminated transparent sheet, said laminated transparent sheet conforming to a portion of said ship and comprising:

a top acrylic layer approximately 0.125 inches thick;

a first urethane layer approximately 0.025 inches thick;

a first polycarbonate layer approximately 0.53 inches thick;

a second urethane layer approximately 0.05 inches thick;

a second polycarbonate layer approximately 0.53 inches thick;

a third urethane layer approximately 0.025 inches thick;

a second acrylic layer approximately 0.125 inches thick;

providing a gasket, said gasket being U-shaped defining a pair of spaced apart legs, each said leg having an outside surface and an inside surface, an inside area formed between said inside surfaces of said legs, said gasket comprising:

compressible or plastic which measures approximately 50–55 shore "A" on a durometer;

two ribs on said outside surface and two ribs on said inside surface of each said leg;

said ribs on a first side of said gasket having a radius of approximately 0.14 inches;

said ribs on second and third sides of said gasket having a radius of approximately 0.156 inches; and said ribs on a fourth side of said gasket having a radius of approximately 0.203 inches;

the perimeter of said laminated sheet being located within said inside area of said gasket;

providing a frame, said frame conforming to a portion of said ship and comprising:

ASTM A-36 structural steel or its equivalent;

an inside width of approximately 35.5 inches, an inside length of approximately 59.36 inches, and an overlap of approximately 3 inches;

slots to provide flexibility, said slots approximately an eighth of an inch wide and approximately 1.56 inches deep; and an inside radius of curvature of approximately 54.4 inches and an outside radius of curvature of approximately 56.2 inches;

overlying said gasket-encompassing transparent sheet with said frame;

providing an opening in said ship over which said transparent sheet may be placed; and attaching said transparent sheet, said gasket, and said frame to said ship at said opening whereby a watertight view window is provided.

3. In combination with a ship, said ship having a hull, said hull being submersible, a plurality of viewing windows mounted within said hull, the construction and mounting of said viewing windows comprising:

a transparent panel constructed of at least one sheet of polycarbonate plastic material having an exterior surface and an interior surface, said interior surface being parallel to said exterior surface, a first urethane sheet completely covering and bonded to said exterior surface, a first acrylic sheet being placed on and bonded to said first urethane sheet completely covering such, the resulting said transparent panel having an edge, said edge being covered with a coating preventing direct contact of the exterior ambient environment to said polycarbonate plastic material, whereby said transparent panel provides a panoramic view of the scene exteriorly of said transparent panel to an observer located interiorly of said hull;

said transparent panel being mounted by mounting means to said hull, said mounting means including an elastomeric gasket, said gasket defining a totally enclosed area with the wall of said gasket being U-shaped defining a space, said edge of said transparent panel being located within said space and said transparent panel being located in said enclosed area, said gasket totally enclosing said edge protecting said edge from the ambient;

a frame mounted by securing means on said hull, said transparent panel and said gasket being located between said frame and said hull with said frame in direct connection with said gasket, said securing means being operable to cause said frame to be moved towards said hull compressing said gasket until a water-tight seal is obtained between said hull and said frame and said gasket and said transparent panel; and there being always a gap between said frame and said hull so as to permit adjusting movement of said frame towards said hull during operation of said securing means.

4. In combination with a ship, said ship having a hull, said hull being submersible, a plurality of viewing windows mounted within said hull, the construction and mounting of said viewing windows comprising:

a transparent panel having an exterior surface and an interior surface, said interior surface being spaced from said exterior surface, said transparent panel having an edge, whereby said transparent panel provides a panoramic view of the scene exteriorly of said transparent panel to an observer located interiorly of said hull;

said transparent panel being mounted by mounting means to said hull, said mounting means including an elastomeric gasket, said gasket defining a totally enclosed area with the wall of said gasket being U-shaped defining a space, said edge of said transparent panel being located within said space and said transparent panel being located in said enclosed area, said gasket totally enclosing said edge protecting said edge from the ambient; and a frame mounted by securing means on said hull, said transparent panel and said gasket being located between said frame and said hull with said frame in direct connection with said gasket, said securing means being operable to cause said frame to be moved towards said hull compressing said gasket until a water-tight seal is obtained between said hull and said frame and said gasket and said transparent panel, there being always a gap between said frame and said hull so as to permit adjusting movement of said frame towards said hull during operation of said securing means.

5. The combination as defined in claim 4 wherein:

said gasket including a plurality of spaced apart continuous protrusions, each said protrusion located parallel to said edge of said transparent panel, said protrusions forming a watertight seal with both said frame and said hull to prevent seepage of water into contact with said edge.

6. The combination as defined in claim 4 wherein:

said frame including a plurality of strengthening ribs preventing deflection of one portion of said frame relative to another portion of said frame.

7. The combination as defined in claim 4 wherein:

said hull being curved, said transparent panel being curved so as to be consistent with said curved shape of said hull, said transparent panel producing a magnification of the view for said observer.

8. The combination as defined in claim 4 wherein:

said interior surface being parallel to said exterior surface.

* * * * *